US006257786B1

(12) United States Patent
Thomas

(10) Patent No.: US 6,257,786 B1
(45) Date of Patent: Jul. 10, 2001

(54) METERING DEVICE FOR STORAGE, MIXTURE AND RELEASE OF DETERGENT WITH WATER

(75) Inventor: Paul Bruce Thomas, San Pedro, CA (US)

(73) Assignee: Carrand Companies, Inc., Compton, CA (US)

( * ) Notice: Subject to any disclaimer, the term of this patent is extended or adjusted under 35 U.S.C. 154(b) by 0 days.

(21) Appl. No.: 09/569,015

(22) Filed: May 11, 2000

(51) Int. Cl.[7] ..... A46B 11/06

(52) U.S. Cl. ..... 401/43; 401/40; 401/42; 401/289; 239/310; 239/318; 222/145.5; 222/630

(58) Field of Search ..... 401/40–43, 268, 401/286, 289, 291; 4/903; 239/310, 314–318, 398, 423, 433, 754; 222/630, 129, 145.1, 145.5

(56) References Cited

U.S. PATENT DOCUMENTS

| | | | | |
|---|---|---|---|---|
| Re. 35,857 | | 7/1998 | Mehoudar . | |
| 1,664,046 | | 3/1928 | Rosenberg . | |
| 2,093,240 | | 9/1937 | Homlquist . | |
| 2,235,278 | * | 3/1941 | Brunner | 239/318 |
| 3,154,086 | | 10/1964 | Barnes . | |
| 3,271,809 | * | 9/1966 | Morawski | 401/42 |
| 4,126,401 | | 11/1978 | Stoyshin . | |
| 4,335,481 | | 6/1982 | Slayman . | |
| 4,796,814 | | 1/1989 | Klemm et al. . | |
| 5,730,178 | | 3/1998 | Zhadanov et al. . | |
| 5,913,327 | | 6/1999 | Zhadanov et al. . | |
| 5,915,622 | | 6/1999 | Foote . | |
| 5,927,610 | | 7/1999 | Dutcher . | |
| 6,116,798 | * | 9/2000 | Chen et al. | 401/42 |

* cited by examiner

*Primary Examiner*—Gregory L. Huson
*Assistant Examiner*—Tuan Nguyen
(74) *Attorney, Agent, or Firm*—George R. McGuire; Hancock & Estabrook, LLP

(57) ABSTRACT

A sudser unit having an entry port, discharge port, and a fluid conduit. The discharge port and fluid conduit extend along a common longitudinal axis, and the entry port extends along a longitudinal axis that intersects the longitudinal axis of the discharge port and fluid conduit at an oblique angle. A water supply, such as a hose, is operably connected to the entry port. A converging nozzle having an opening of smaller diameter than that of the entry port is attached to the discharge port, and a detergent reservoir is attached to the fluid conduit. A valve is disposed between the reservoir and fluid conduit. A valve is disposed between the reservoir and fluid conduit to permit selective mixing of the water and detergent, and selective metering of the mixed composition. Due to the pressure differential created as a result of the relative sizes of the entry and discharge points, when the valve is open, a cycling effect of water and detergent is created, effectively mixing the two together and creating suds composition.

24 Claims, 4 Drawing Sheets

METERING DEVICE FOR STORAGE, MIXTURE AND RELEASE OF DETERGENT WITH WATER

BACKGROUND OF THE INVENTION

The present invention relates to automotive cleaning equipment, and more particularly to spray nozzles wherein water is mixed with a detergent concentrate prior to ejection from the nozzle.

Devices for metering the storage, release and mixture of concentrated soap into a water stream are well known in the automotive cleaning accessory industry. These devices are commonly referred to as "sudsers." Sudsers generally include a connector for operably attaching a hose to one end thereof, a reservoir for storing concentrated soap and through which the water stream must pass to mix the water and soap, and a nozzle for dispensing the water/soap mixture. A cleaning device, such as a brush or squeegee, may be connected in fluid communication to the nozzle, and includes apertures through which the water/soap mixture finally passes.

The prior art sudser technology does effectively mix the soap concentrate and water. However, due to pressure differentials between the soap reservoir and water, the mixture of the two is inefficient and, at times, inconsistent. Thus, the expelled water/soap mixture is over or under saturated at various times of use. Examples of prior art sudsers are disclosed in U.S. Pat. Nos. 4,335,481 to Slyaman; U.S. Pat. No. 4,126,401 to Stoyshin; and U.S. Pat. No. 3,154,086 to Barnes.

It is a principal object and advantage of the present invention to provide a sudser device that consistently mixes a soap concentrate with water.

It is a further object and advantage of the present invention to provide a sudser that is easily handled.

It is another object and advantage of the present invention to provide a sudser having an easily refillable soap concentrate reservoir.

Other objects and advantages of the present invention will in part be obvious, and in part appear hereinafter.

SUMMARY OF THE INVENTION

In accordance with the foregoing objects and advantages, the present invention provides a Y-shaped sudser unit, wherein water is introduced into a first chamber via a hose attached to one leg of the unit, and a soap concentrate is positioned in a second chamber which is positioned rearwardly in the unit relative to the first chamber. A valve is operably positioned in the conduit between the first and second chambers. If the valve is closed, the water introduced in the first chamber will be discharged therefrom through an outlet. Due to the outlet being smaller in diameter than the opening through which the water first passes into the first chamber, the pressure differential will force the water through the opening. The velocity of the discharged water may be further enhanced by forming the outlet as a converging nozzle.

When the valve is open, the smaller outlet will create a pressure differential resulting in the flow of water from the first chamber into the second chamber. The pressure in the first and second chambers will ultimately reach an equilibrium causing a cycling effect (e.g., a very weak venturi effect) of the water circulating through the second chamber creating a mixture of the water with the viscous detergent gel concentrate housed in the second chamber. After circulating through the detergent, the thinner water will then exit the second chamber, and be expelled from the unit through the discharge opening.

A cleaning utensil, such as a scrubber brush or squeegee, can be operably attached to and positioned in fluid communication with the discharge opening. Openings formed in the cleaning utensil permit the soap/water (suds) mixture to pass therethrough, thereby permitting effective cleaning of a vehicle or other object.

BRIEF DESCRIPTION OF THE DRAWINGS

The present invention will be more fully understood by reading the following Detailed Description in conjunction with the accompanying drawings, wherein.

DETAILED DESCRIPTION

Figure 1:
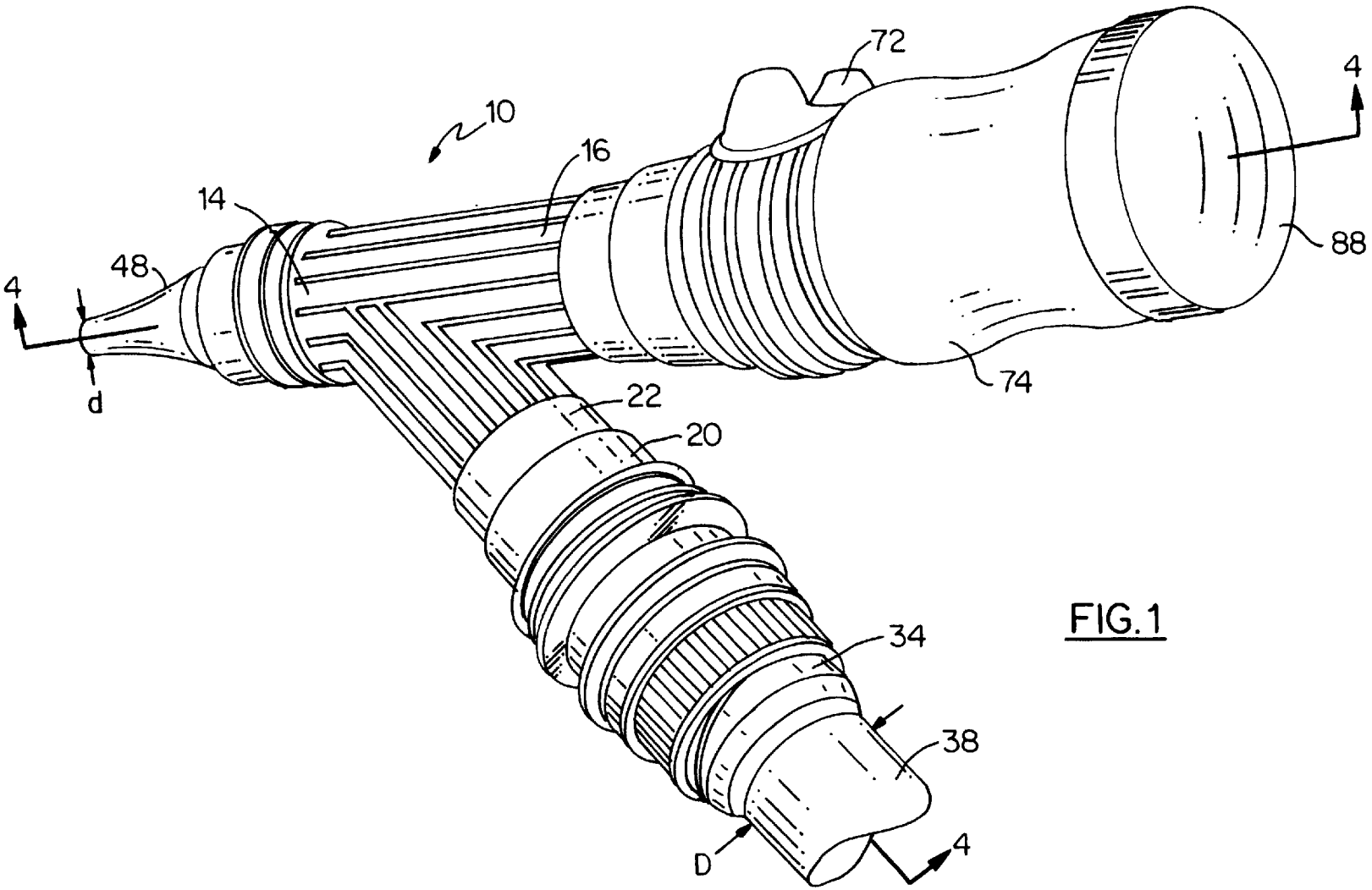
FIG. 1 is a perspective view of the present invention.
Figure 4:
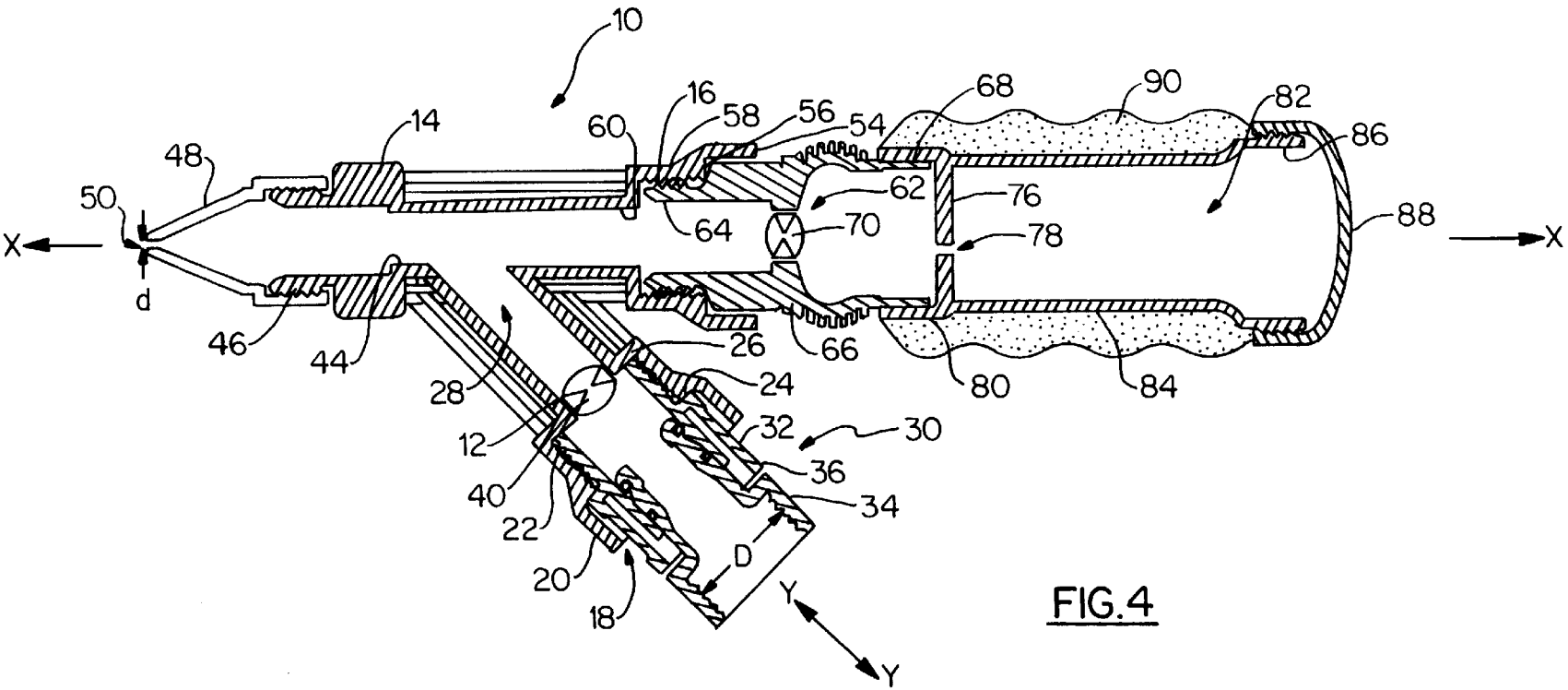
FIG. 4 is a cross-sectional view of the present invention taken along lines 4—4 in FIG. 1.

Referring now to the drawings, wherein like reference numerals refer to like parts throughout, there is seen in FIG. 1 a sudser unit, denoted generally by reference numeral 10. Sudser 10 essentially comprises a water entry port 12, a discharge port 14 positioned in fluid communication with and forward relative to entry port 12, and a fluid conduit 16 positioned in fluid communication with and rearwardly relative to entry port 12. Entry port 12 extends along a longitudinal axis Y—Y that intersects the common longitudinal axis X—X of discharge port 14 and fluid conduit 16 at an oblique angle which is acute between entry port 12 and fluid conduit 16, and obtuse between entry port 12 and discharge port 14 (see FIG. 4).

Entry port 12 includes an open end 18 defined by cylindrical wall 20 which transitions into a smaller diameter, internally threaded collar 22 at a shoulder 24. Collar 22 terminates at a shoulder 26 at which point it transitions into passageway 28 through which liquid, such as water, may flow.

Figure 5:
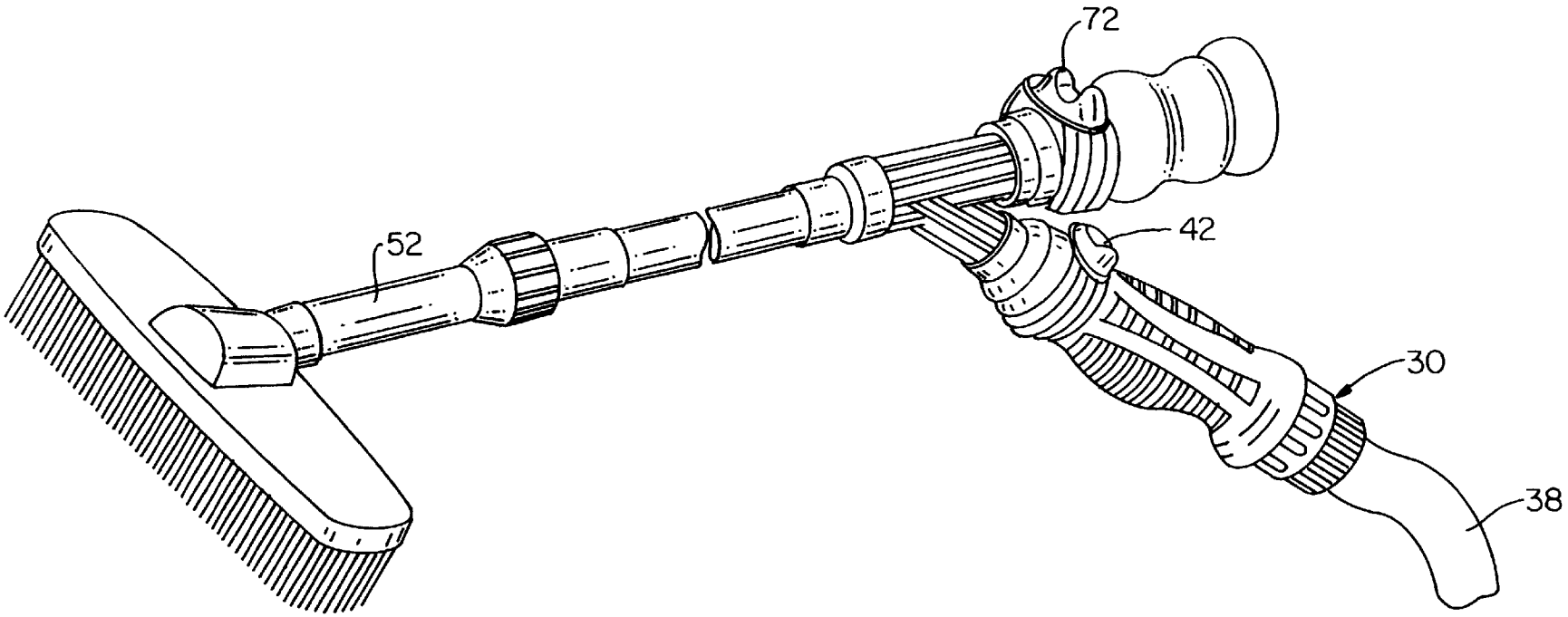
FIG. 5 is a perspective view of the present invention with a cleaning utensil attached thereto.

A conventional swivel connector, designated generally by reference numeral 30, includes an externally threaded member 32 threadingly engaged with collar 22, and an internally threaded member 34 rotatably attached to externally threaded member 32. An O-ring 36, or similar sealing member, is disposed at the interface between members 32 and 34 to prevent liquid from leaking from connector 30. A hose 38 (see FIG. 5), or other liquid supply, may be releaseably connected to connector 30, thereby providing a source of liquid to sudser 10. A valve 40 operable via a switch 42 (see FIG. 5) provides a shut-off for the liquid supply passing through entry port 12. The entry point for water into sudser 10 is at connection 30 which accepts a hose 38 of diameter D. It should be noted that hose 38 could be attached directly to entry port 12 at threaded collar 22 (also of diameter D). In this arrangement, the unit loses its ability to prevent kinking of the hose through its twisting.

Discharge port 14 includes a reduced diameter entry point 44 which transitions into a larger diameter, externally threaded collar 46. A converging nozzle 48 threadingly engages collar 46, and includes an open tip 50 of diameter d, smaller than the diameter D of connection 30, through which liquid or liquid soap mixture is discharged. Although sudser 10 can be used to spray the water/soap mixture directly from nozzle 48, a cleaning implement 52 (see FIG. 5) may also threadingly engage collar 46, thereby enhancing the versatility of sudser 10. Although implement 52 is illustrated as a scrub brush, it should be understood that any type of conventional cleaning implement, such as squeegee, could engage collar 46.

Fluid conduit 16 includes an open end 54 that steps down at a shoulder 56 to an internally threaded collar 58. Collar 58 steps then down at a shoulder 56 to a passageway 60.

A conventional valve unit 62 includes an externally threaded open end 64 that threadably connects it to collar 58. Valve unit 62 further includes a body portion 66 extending rearwardly from end 64, relative to sudser 10, and terminates in an open end 68. A valve mechanism 70 positioned within valve unit 62 is operable between open and closed positions via a switch 72.

Removably attached to the open end 68 of valve unit 62 is a detergent reservoir 74. Reservoir 74 includes a wall 76 extending transversely therein and having an opening 78 formed therethrough, a flange 80 extending forward from wall 76 (relative to sudser unit 10), and a mixing chamber 82 defined by wall 84 extending rearwardly from wall 76 (relative to sudser unit 10), and including an open end 68. A cap 88 is removably attached in covering relation to end 86, and a handle 90 is attached to the outwardly facing surfaces of reservoir 74. Handle 90 is preferably composed of a resilient, gelatinous material to ergonomically contour to a user's hand.

Figure 2:
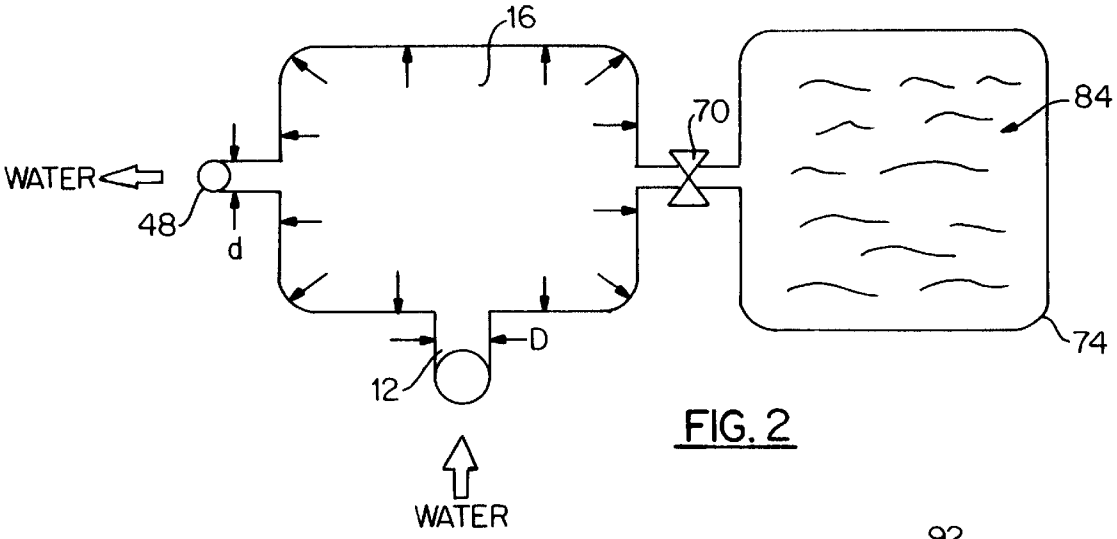
FIG. 2 is a schematic representation of the fluid flow in the present invention with the valve positioned in its closed position.
Figure 3:
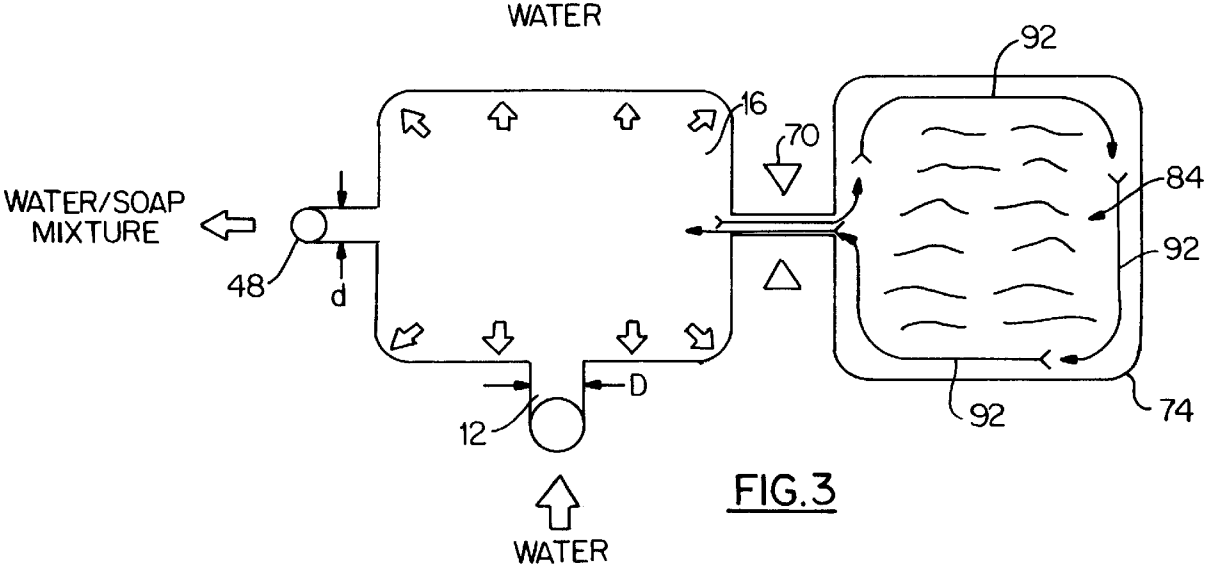
FIG. 3 is a schematic representation of the fluid flow in the present invention with the valve positioned in its open position.

As best illustrated in FIGS. 2–3, in operation, a conventional detergent concentrate, preferably in gel form as that constitution enhances the mixing of water and gel, fills reservoir 74 (if reservoir 74 is empty, cap 88 may be removed, reservoir 74 re-filled with detergent and cap 88 replaced), and a water hose 38 is attached to entry port 12 as described hereinabove. Valve 40 is then put in an open position, thereby permitting water to flow through entry port 12 and into unit 10. If valve 70 is in its closed position, the water will flow into fluid conduit 16 and out nozzle 48. Due to the reduced diameter of nozzle 48 relative to connector 34, the pressure in fluid conduit 16 will reach an equilibrium prior to water being discharged. The converging nature of nozzle 48 will result in an acceleration of the water as it passes through end 50.

To induce a mixture of the water with the detergent concentrate, valve 70 is moved to its open position. Due to the smaller diameter of nozzle 48 relative to connector 34, the water flowing through entry port 12, the water will flow rearwardly through valve unit 62, and into mixing chamber 82 of reservoir 74. Due to the lower density of the water relative to the detergent concentrate, a cycling effect of the water through the detergent will be created (e.g., a slight venturi will be created), thereby circulating the water and concentrate through mixing chamber 82, as indicated by the arrows 92 in FIG. 3. Ultimately the pressure in chamber 82 will come to an equilibrium with the pressure in fluid conduit 16, and the mixed water/gel composition (i.e., the diluted detergent composition) will exit reservoir 74 through valve unit 62, and ultimately through nozzle 48. Selective control of valve 70 permits selective metering of the diluted detergent composition from sudser 10. It should be understood that the present invention would work equally well by switching the positions of entry port 12 and fluid conduit 16 (and associated structures) relative to discharge port 14.

Once the water and detergent have had time to mix with one another, a useful application of device 10 is to pulse valve 62 between its open and closed positions. When valve 62 is first opened, the pressure differential created thereby results in a proportionately large rush of the mixed water and detergent flowing through nozzle 48. Conversely, closing valve 62 will eliminate mixed water and detergent from existing device 10. Thus, by pulsing valve 62 between its open and closed positions, large quantities of suds can be expelled from unit 10 in periodic intervals.

What is claimed is:

1. A sudser unit adapted to receive a water supply and mix said water supply with a detergent concentrate, said sudser unit comprising;

(a) an entry port having an open end of a first diameter adapted to receive said water supply and extending along a first longitudinal axis, a discharge port and a fluid conduit each having respective open ends, and each extending along a common second longitudinal axis, wherein said entry port, discharge port and fluid conduit are in fluid communication relative to one another;

(b) a discharge element connected to said open end of said discharge port, and having an open end of a second diameter smaller than said first diameter;

(c) a valve operably connected to said open end of said fluid conduit; and (d) an enclosed reservoir extending along said second longitudinal axis, having first and second opposed ends and attached to said valve, opposite said fluid conduit, at its said first end.

2. The sudser unit of claim 1, and further comprising a swivel connection having opposing open ends and being operably attached at one of its said open ends to said open end of said entry port, and its other said open end is adapted to operably receive said water supply.

3. The sudser unit of claim 1, and further comprising a handle positioned in covering relation to said reservoir.

4. The sudser unit of claim 3, wherein said handle is composed of a gelatinous material.

5. The sudser unit of claim 1, wherein said reservoir further includes a cap removably attached to its said second end.

6. The sudser unit of claim 1, wherein said discharge element is a converging nozzle.

7. The sudser unit of claim 1, wherein said discharge element includes a cleaning implement attached thereto.

8. The sudser unit of claim 7, wherein said cleaning implement is a brush.

9. The sudser unit of claim 1, wherein said first longitudinal axis intersects said second longitudinal axis at an oblique angle and at a point between said discharge port and said fluid conduit.

10. The sudser unit of claim 9, wherein said oblique angle is acute between said entry port and said fluid conduit.

11. The sudser unit of claim 1, wherein said valve is selectively operable between open and closed positions via a user accessible switch.

12. The sudser unit comprising:

(a) an entry port having an open end of a first diameter adapted to receive said water supply and extending along a first longitudinal axis, a discharge port and a fluid conduit each having respective open ends, and each extending along a common second longitudinal axis, wherein said entry port, discharge port and fluid conduit are in fluid communication relative to one another;

(b) a discharge element connected to said open end of said discharge port, and having an open end of a second diameter smaller than said first diameter;

(c) means for supplying detergent concentrate to said sudser unit comprising an enclosed reservoir extending along said second longitudinal axis, having first and second opposed ends and being operably attached to said fluid conduit, at it's said first end; and (d) means for metering the mixture and release of said detergent concentrate.

13. The sudser unit of claim 12, wherein said reservoir includes a cap removably attached to its said second end.

14. The sudser unit of claim 12, wherein said reservoir includes a wall positioned therein between its said first and second ends and extending transversely there across, said wall including an opening formed there through.

15. The sudser unit of claim 12, wherein said metering means is comprised of a valve operably disposed between said fluid conduit and said detergent supply means.

16. The sudser unit of claim 15, wherein said valve is selectively operable between open and closed positions via a user accessible switch.

17. The sudser unit of claim 12, and further comprising a swivel connector having opposing ends and being operably attached at one of its ends to said open end of said entry port, and its other said open end is adapted to operably receive said water supply.

18. The sudser unit of claim 12, and further comprising a handle positioned in covering relation to said reservoir.

19. The sudser unit of claim 18, wherein said handle is composed of a gelatinous material.

20. The sudser unit of claim 12, wherein said discharge element is a converging nozzle.

21. The sudser unit of claim 12, wherein said discharge element includes a cleaning implement attached thereto.

22. The sudser unit of claim 21, wherein said cleaning implement is a brush.

23. The sudser unit of claim 12, wherein said first longitudinal axis intersects said second longitudinal axis at an oblique angle.

24. The sudser unit of claim 23, wherein said oblique angle is acute between said entry port and said fluid conduit.

* * * * *